US009758910B2

(12) United States Patent
Hanada et al.

(10) Patent No.: US 9,758,910 B2
(45) Date of Patent: Sep. 12, 2017

(54) THROAT PLATE SWITCHING MECHANISM

(71) Applicant: JUKI CORPORATION, Tama-shi, Tokyo (JP)

(72) Inventors: Tsuyoshi Hanada, Tokyo (JP); Naofumi Fukuba, Tokyo (JP)

(73) Assignee: JUKI CORPORATION, Tama-shi, Tokyo (JP)

( * ) Notice: Subject to any disclaimer, the term of this patent is extended or adjusted under 35 U.S.C. 154(b) by 0 days.

(21) Appl. No.: 15/265,871

(22) Filed: Sep. 15, 2016

(65) Prior Publication Data

US 2017/0081795 A1 Mar. 23, 2017

(30) Foreign Application Priority Data

Sep. 18, 2015 (JP) ..... 2015-185765

(51) Int. Cl.
*D05B 73/12* (2006.01)
*D05B 73/00* (2006.01)

(52) U.S. Cl.
CPC ..... *D05B 73/12* (2013.01); *D05B 73/005* (2013.01)

(58) Field of Classification Search
CPC ..... D05B 73/12; D05B 73/005
See application file for complete search history.

(56) References Cited

U.S. PATENT DOCUMENTS 1,342,903 A * 6/1920 Graham ..... D05B 73/12 112/45
3,131,659 A * 5/1964 Idomoto ..... D05B 73/12 112/260
3,926,133 A * 12/1975 Herron ..... D05B 19/02 112/168
4,150,633 A * 4/1979 Adams ..... D05B 3/246 112/260
4,395,962 A * 8/1983 Odermann ..... D05B 73/12 112/168
7,194,969 B2 * 3/2007 Niizeki ..... D05B 73/12 112/260
8,215,250 B2 * 7/2012 Fukao ..... D05B 73/12 112/260
8,261,679 B2 * 9/2012 Ihira ..... D05B 3/14 112/221
8,485,114 B2 * 7/2013 Fukao ..... D05B 73/12 112/260
2010/0224111 A1 9/2010 Ihira et al.

FOREIGN PATENT DOCUMENTS

JP 2010-201013 A 9/2010

* cited by examiner

*Primary Examiner* — Danny Worrell
(74) *Attorney, Agent, or Firm* — Drinker Biddle & Reath LLP

(57) ABSTRACT

A throat plate switching mechanism includes a first throat plate and a second throat plate. The first throat plate is formed with a first needle hole having an elongated hole shape at a stitch point. The second throat plate is formed with a second needle hole. A width of the second needle hole is narrower than a width of the first needle hole. The second throat plate is equipped in the first throat plate such that the second throat plate is switched into a use position at which the second needle hole overlaps the first needle hole, and a retreated position at which the second throat plate does not cover the first needle hole.

2 Claims, 7 Drawing Sheets

THROAT PLATE SWITCHING MECHANISM

CROSS-REFERENCE TO RELATED APPLICATIONS

This application is based upon and claims the benefit of priority from Japanese Patent Application No. 2015-185765, filed on Sep. 18, 2015, the entire contents of which are incorporated herein by reference.

BACKGROUND OF INVENTION

Field of the Invention

The present invention relates to a throat plate switching mechanism of a sewing machine.

Related Art

In a sewing machine that is capable of performing a plurality of kinds of stitches, such as selectively performing a stitch for performing a needle oscillation and a stitch for not performing the needle oscillation, or selectively performing a stitch using a single stitch needle and a stitch using a plurality of stitch needles, a throat plate formed with an elongated hole-like needle hole extending along a needle oscillation direction or an arranged direction of the stitch needle was used, and even in the case of a stitch for not performing the needle oscillation and a stitch using a single stitch needle, a throat plate formed with an elongated hole-like needle hole was used (e.g., see JP-A-2010-201013).

SUMMARY OF INVENTION

However, when the throat plate formed with the elongated hole-like needle hole was used in the stitch for not performing the needle oscillation and the stitch using a single stitch needle, since the needle hole is large, there was a problem that a workpiece was liable to greatly sink downward at a stitch point, and a stitching quality was lowered.

Since the width of the needle hole is wide, in the case of a workpiece in which there was a step on a lower side to overlap the fabric, there was a fear that a stepped portion was caught by the needle hole to cause damage or scratches on the workpiece or cause a defective stitch.

In order to solve the aforementioned problems, measures of preparing a throat plate formed with an elongated hole-like needle hole, and a throat plate formed with a round hole-like needle hole, and replacing the throat plate with one suitable for stitching for each stitching are considered.

However, in the aforementioned measures, there were fears of a complicated replacement work of the throat plate, a need for storing the throat plate which was not used, and a risk of losing the throat plate that was not used, and there was a problem of a large harmful effect.

An object of the present invention is to allow stitching to be performed at a appropriate needle hole according to the stitch pattern.

(1) A throat plate switching mechanism includes a first throat and a second throat. The first throat plate is formed with a first needle hole having an elongated hole shape at a stitch point. The second throat plate is formed with a second needle hole. A width of the second needle hole is narrower than a width of the first needle hole. The second throat plate is equipped in the first throat plate such that the second throat plate is switched into a use position at which the second needle hole overlaps the first needle hole, and a retreated position at which the second throat plate does not cover the first needle hole.

(2) In the throat plate switching mechanism according to (1), the first throat plate is equipped with an operating lever which manually moves the second throat plate.

(3) The throat plate switching mechanism according to (2), further includes a shuttle cover. The shuttle cover is attachable to and detachable from a throat plate opening which is formed in the first throat plate. The operating lever is mounted on a bottom surface side of the first throat plate, and an operating end portion of the operating lever is disposed so as to be the inner side of the throat plate opening in a plan view. The operating end portion of the operating lever has a convex shape which protrudes upward. The shuttle cover is formed with two recesses or is formed with two openings. The operating end portion is fitted to one recess when the second throat plate is at the use position, and the operating end portion is fitted to the other recess when the second throat plate is at the retracted position, respectively. The operating end portion is fitted to one opening when the second throat plate is at the use position, and the operating end portion is fitted to the other opening when the second throat plate is at the retracted position, respectively.

(4) In the throat plate switching mechanism according to (3), the operating end portion of the operating lever has a convex shape which width is gradually narrower upward. A guide protrusion is formed on a bottom surface of the shuttle cover between the two recesses or between the two openings, and is configured to guide the operating end portion of the operating lever to one of the two recesses or one of the two openings.

According to the present invention, since the second throat plate is equipped in the first throat plate such that the second throat plate can be switched into a use position at which the first needle hole and the second needle hole overlap each other, and a retreated position at which the second throat plate does not cover the first needle hole, it is possible to select an appropriate needle hole in accordance with the presence or absence of the needle oscillation in the sewing machine, the number of the stitching needle and the like, and it is possible to reduce an occurrence of dents and catching to the workpiece.

Moreover, since the position of the second throat plate can be switched, replacement of the throat plate itself is not required, thereby being able to eliminate the complexity of the replacement work and to perform an efficient stitching work by reducing the working time. Moreover, since the replacement of the throat plate is not required, it is possible to prevent the loss of the unused throat plate and to eliminate the need to secure the storage space.

DETAILED DESCRIPTION

Hereinafter, a throat plate switching mechanism 10 of a sewing machine according to the present invention will be described with reference to the accompanying drawings. The throat plate switching mechanism 10 is provided at a stitch point of a bed portion to allow a selective use of an elongated hole-like first needle hole 21 and a round hole-like second needle hole 41 having a width narrower than the first needle hole 21.

Figure 1:
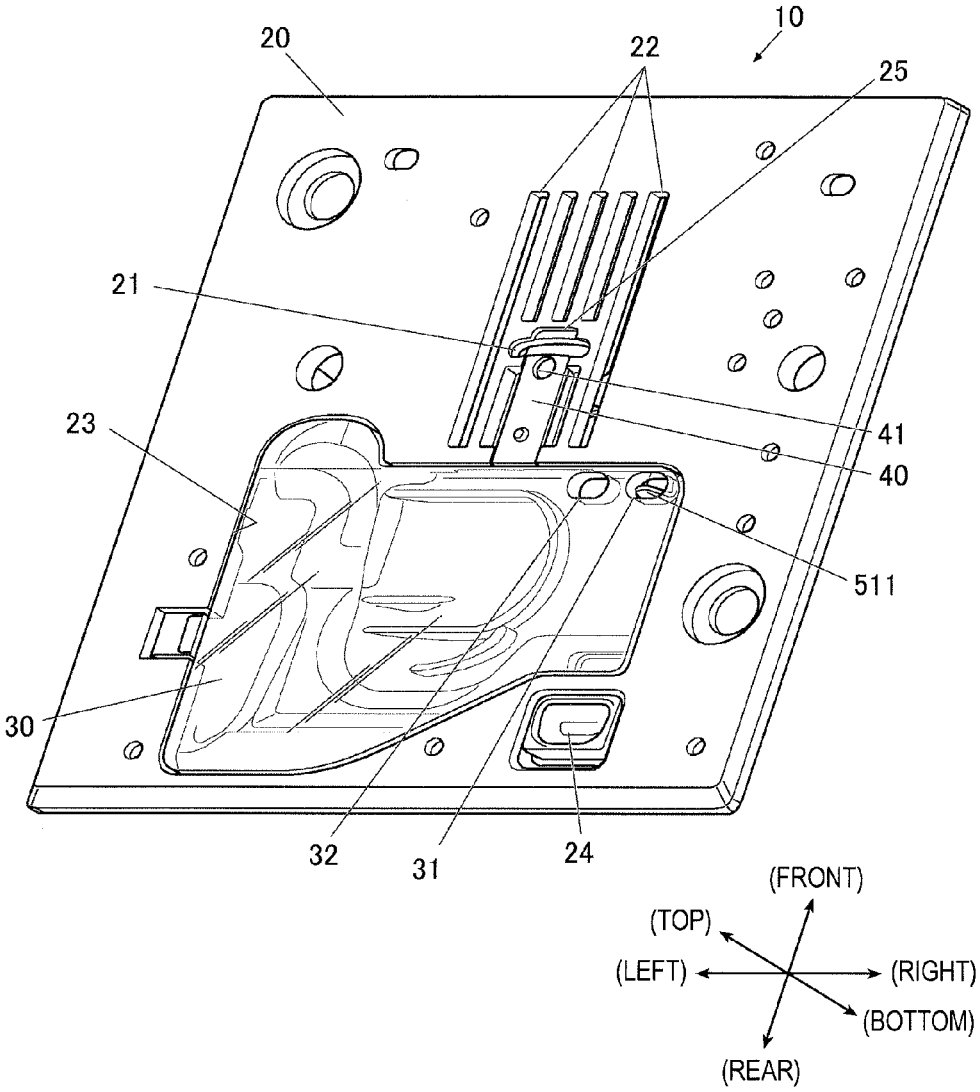
FIG. 1 is a perspective view of a throat plate switching mechanism in which a use state of a first needle hole is viewed from an obliquely upward direction.
Figure 2:
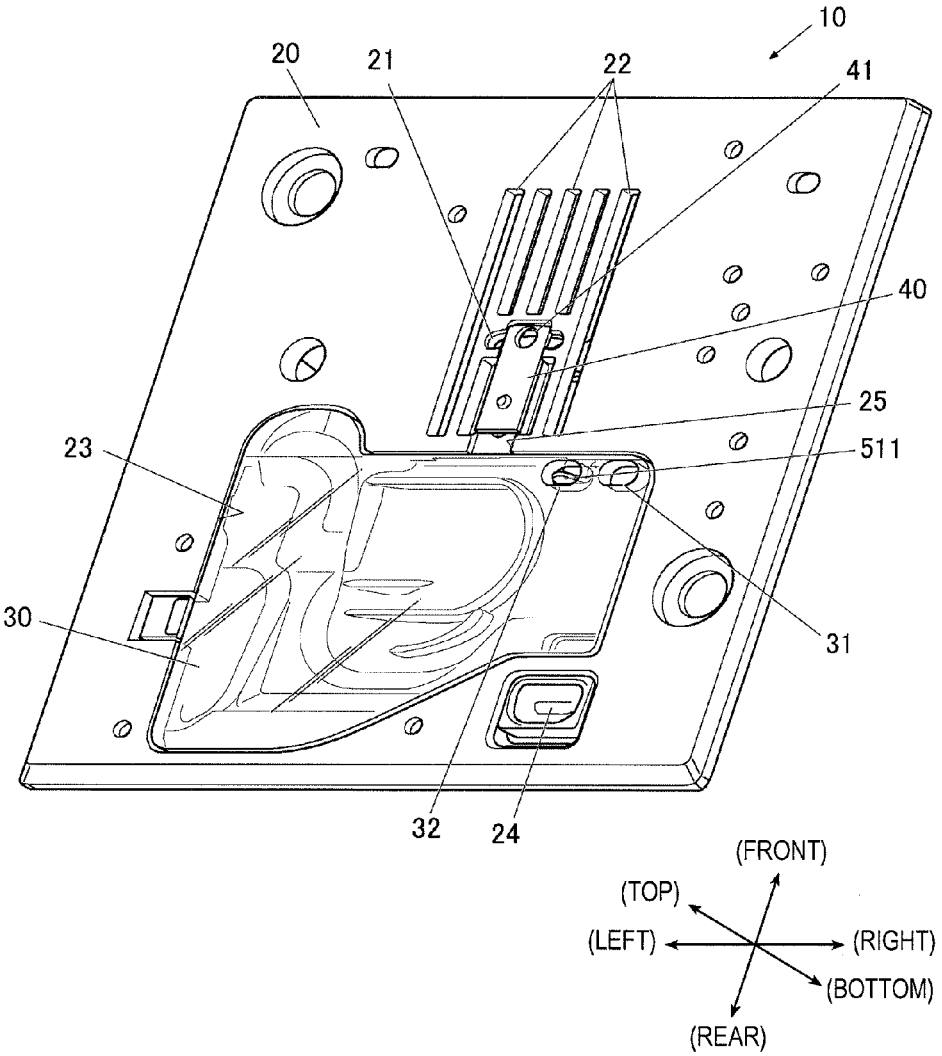
FIG. 2 is a perspective view of the throat plate switching mechanism in which a use state of a second needle hole is viewed from the obliquely upward direction.
Figure 3:
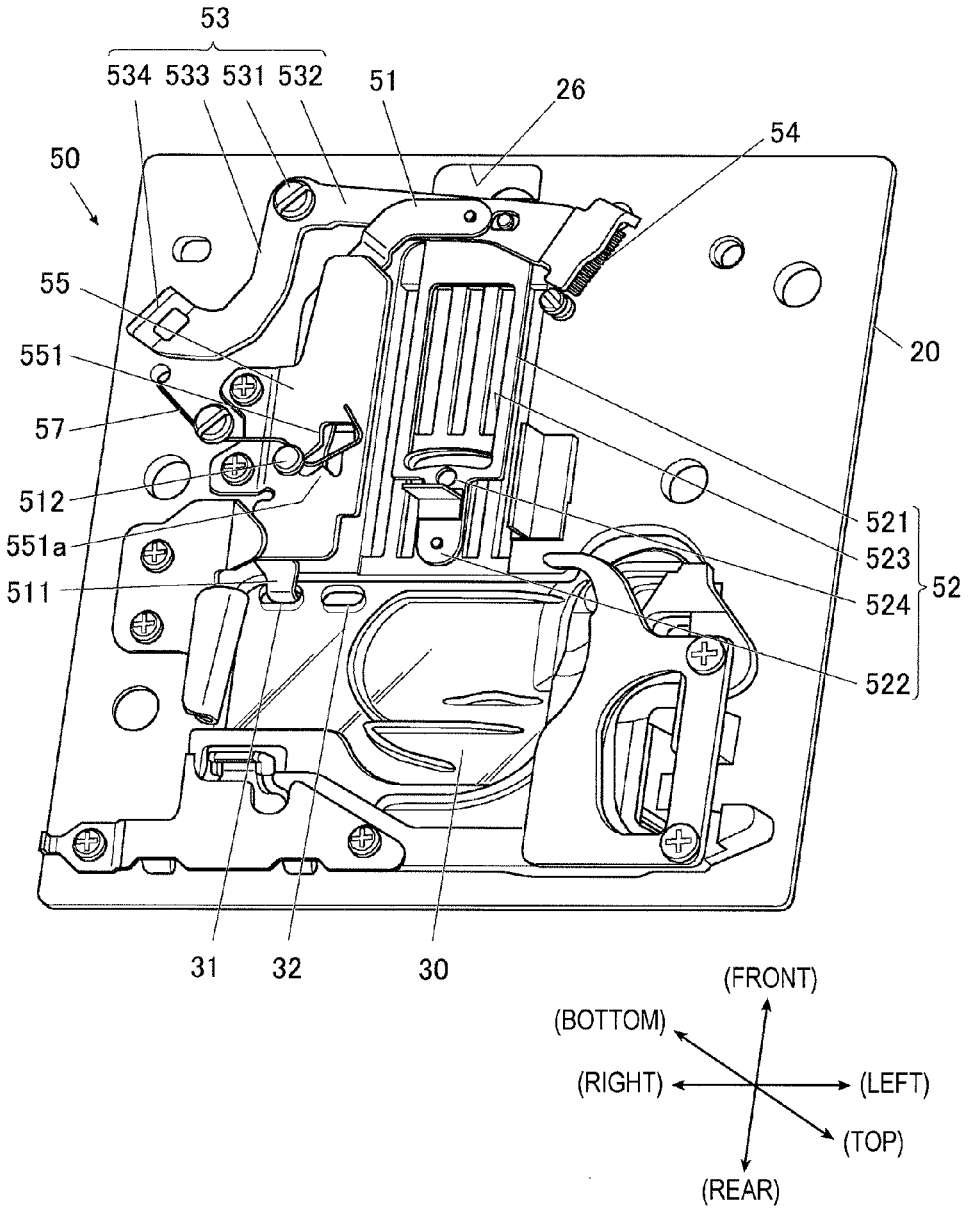
FIG. 3 is a bottom perspective view of the throat plate switching mechanism viewed from an obliquely downward direction.

FIG. 1 is a perspective view of a throat plate switching mechanism 10 in which a use state of the first needle hole 21 is viewed from an obliquely upward direction, FIG. 2 is a perspective view in which a use state of the second needle hole 41 is viewed from the obliquely upward direction, and FIG. 3 is a perspective view of the throat plate switching mechanism 10 viewed from an obliquely downward direction.

In the following description, a downstream side in a cloth feed direction as a horizontal direction will be set as a "front", an upstream side in the cloth feed direction as the horizontal direction will be set as a "rear", a left side facing the front in the horizontal direction will be set as a "left", a right side facing the front in the horizontal direction will be set as a "right", an upper side in a vertical downward direction will be set as a "top", and a lower side in the vertical downward direction will be set as a "bottom". These directions indicate a direction in a state in which the throat plate switching mechanism 10 is mounted on the sewing machine.

The throat plate switching mechanism 10 includes a first throat plate 20 in which the elongated hole-like first needle hole 21 is formed at a stitch point, a second throat plate 40 formed with a second needle hole 41 having a width narrower than the first needle hole 21, and a position switching mechanism 50 for switching the second throat plate 40 to two positions to be described later.

[First Throat Plate]

The first throat plate 20 is a rectangular flat plate that is slightly long in a front-rear direction, and on the slight front side of the central portion thereof, the elongated hole-like first needle hole 21 extending along the left-right direction is formed to pass through the vertical direction. Further, a plurality of slit-like feed dot protruding holes 22 extending in the front-rear direction are formed to surround the periphery of the first needle hole 21.

On the rear side of the first needle hole 21 and the feed dot protruding holes 22 of the first throat plate 20, a throat plate opening 23 which is widely opened to perform a work such as replacement of the shuttle located below the first throat plate 20 is formed.

The throat plate opening 23 has a substantially rectangular shape in which a left front end thereof protrudes forward in a semi-circular shape and a rear right end is recessed forward, as viewed from the top. A shuttle cover 30 made of a transparent resin of the same shape is attached to the throat plate opening 23.

The shuttle cover 30 has the same outer shape as the shape of the throat plate opening 23, is fitted to the inside of the throat plate opening 23 in a state in which its outer edge is mounted on a stepped portion (not illustrated) formed on the inner edge portion of the throat plate opening 23 of the first throat plate 20, thereby being able to block the entire throat plate opening 23. Reference numeral 24 is an operating member which manually retracts a locking claw (not illustrated) equipped to protrude to the shuttle cover 30 side by the elastic member at the bottom surface side of the first throat plate 20. That is, the shuttle cover 30 is maintained in a state of being mounted on the throat plate opening 23 by the locking claw, and can be detached from the throat plate opening 23 by the retraction operation of the operating member 24.

On the top surface of the first throat plate 20, from the front end of the throat plate opening 23 to a somewhat front position beyond the first needle hole 21, a guide groove 25 extending along the front-rear direction is formed, and the second throat plate 40 is mounted on the inside of the guide groove 25.

[Second Throat Plate]

The second throat plate 40 is a rectangular flat plate that is long in the front-rear direction, and is formed to be thinner than the first throat plate 20. The second needle hole 41 is formed through the vicinity of the front end of the second throat plate 40. The second needle hole 41 is a round hole having the same inner diameter as the front and rear width of the first needle hole 21.

Further, the second throat plate 40 is mounted inside the aforementioned guide groove 25 to be movable back and forth. The thickness of the second throat plate 40 is substantially matched the depth of the guide groove 25, and when being mounted to the inside of the guide groove 25, a top surface of the second throat plate 40 flushes with the top surface of the first throat plate 20.

The length in the front-rear direction of the second throat plate 40 is equal to or somewhat shorter than the distance from the front end of the throat plate opening 23 to the rear end of the first needle hole 21, and the second throat plate 40 is mounted within the guide groove 25 to be slide-movable back and forth. When retracting the second throat plate 40 to the guide groove 25 to the maximum degree, as illustrated in FIG. 1, the second throat plate 40 is located at the retracted position that does not entirely cover the first needle hole 21 of the first throat plate 20, and when advancing the second throat plate 40 to the guide groove 25 to the maximum degree, as illustrated in FIG. 2, the second throat plate 40 is located at a use position at which the second needle hole 41 formed on the second throat plate 40 overlaps the first needle hole 21 of the first throat plate 20. At the use position, the second needle hole 41 becomes the inside of the first needle hole 21, and the second needle hole 41 in a plan view enters a state of penetrating in the vertical direction without being totally covered.

[Position Switching Mechanism]

FIG. 3 is a perspective view in which the position switching mechanism 50 is viewed from the bottom. The position switching mechanism 50 is provided on the bottom surface side of the first throat plate 20, and includes an operating lever 51 that manually moves the second throat plate 40, a slide plate 52 that is connected to the second throat plate 40 on the bottom surface side of the first throat plate 20, a drive arm 53 that connects the operating lever 51 and the slide plate 52, a tension spring 54 as an elastic body that urges the second throat plate 40 from the use position to the retracted position side via the drive arm 53, an operating lever presser 55 that holds the operating lever 51, and a position sensor 56 that detects whether the second throat plate 40 is positioned at the retracted position or the use position via the drive arm 53 (see FIGS. 4 to 6).

The slide plate 52 includes a rectangular main body 521 that is long in the front-rear direction, and an extending portion 522 that extends rearward from the rear end of the main body 521.

The extending portion 522 of the slide plate 52 is connected to the second throat plate 40 via a pin inserted through an elongated hole (not illustrated) formed to penetrate the first throat plate 20 vertically and extending along the front-rear direction. Further, a front end of the main body 521 is stored in the slide groove 26 formed on the bottom surface of the first throat plate 20, and the slide plate 52 is mounted to the bottom surface of the first throat plate 20 in a slidable state in the front-rear direction.

In the main body 521, the rectangular opening 523 long in the front-rear direction is widely formed, avoids a plurality of feed dot protruding holes 22 formed on the first throat plate 20, and does not cover the respective retraction holes 22 even if it moves back and forth.

When the second throat plate 40 is located at the retracted position, the lower end of the opening 523 of the main body 521 overlaps the first needle hole 21 in a plan view, and does not cover the first needle hole 21.

The extending portion 522 is located approximately just below the second throat plate 40 with the first throat plate 20 interposed therebetween, and an opening 524 of the same dimension is formed at the same position as the second needle hole 41 in a plan view. The second needle hole 41 is not covered by the opening 524.

The drive arm 53 is a so-called bell crank, and is supported to be pivotable about an axis extending along the vertical direction with respect to the first throat plate 20 by a shoulder screw 531. The drive arm 53 includes a first pivot arm 532 which generally extends to the left side from the rotation center position of the shoulder screw 531, and a second pivot arm 533 that generally extends rearward.

The first pivot arm 532 has an elongated hole extending along the left-right direction in the vicinity of the pivot end, and a pin protruding downward on the bottom surface of the front end of the main body 521 of the slide plate 52 is inserted into the elongated hole. Further, when the first pivot arm 532 rotates back and forth, it is possible to switch the second throat plate 40 into the retracted position and the use position by moving the second throat plate 40 back and forth via the slide plate 52.

The tension spring 54 is connected to the pivot end of the first pivot arm 532, and the rearward tension is urged.

The detection target portion 534 of the position sensor 56 is formed at the pivot end of the second pivot arm 533. The detection target portion 534 will be described later.

The operating lever 51 is a link member made up of an elongated flat plate generally extending along the front-rear direction, and its front end is connected to the vicinity of the pivot end of the first pivot arm 532 of the drive arm 53 by the support shaft extending along the vertical direction. At the rear end of the operating lever 51, an operating end portion 511 for manually inputting the pivoting operation to the operating lever 51 is formed.

The operating end portion 511 extends to the inner region of the throat plate opening 23 of the first throat plate 20 in a plan view, and its front end is erected upward by bending. Further, the erected portion at the operating end portion 511 has a substantially semicircular shape that protrudes upward (see FIG. 7).

Since the operating end portion 511 is located on the inner region of the throat plate opening 23, when removing the shuttle cover 30 from the throat plate opening 23 of the first throat plate 20, it is possible to add the manual operation.

The operating lever 51 is supported, while being interposed between a flat plate-shaped operating lever presser 55 fixedly mounted on the bottom surface side of the first throat plate 20 and the first throat plate 20. Moreover, the pin 512 projecting downward at the intermediate position in the longitudinal direction of the operating lever 51 is loosely inserted into the guide hole 551 that is formed on the operating lever presser 55. The pin 512 is made up of an shaft portion that is loosely inserted into the guide hole 551 and a head portion provided at the lower end of the shaft portion to have an outer diameter larger than the shaft portion, and the head portion prevents the pin 512 from coming out of the guide hole 551.

Further, the guide hole 551 formed in the operating lever presser 55 allows the pin 512 to move in the left-right direction, which enables the rear end side of the operating lever 51 to pivot in the left-right direction. When the pin 512 is located in the right end of the guide hole 551, the second throat plate 40 is maintained at the retracted position via the drive arm 53 and the slide plate 52, and when the pin 512 is located at the left end of the guide hole 551, the second throat plate 40 is moved to the use position via the drive arm 53 and the slide plate 52.

A convex portion 551*a* projecting forward is formed between both the left and right ends of the guide hole 551, the pin 512 is pressed at a position between the left end of the guide hole 551 and the convex portion 551*a*, or between the right end of the guide hole and the convex portion 551*a*, via the drive arm 53 and the operating lever 51 by the tension spring 54, and the second throat plate 40 is maintained at the use position or the retracted position. On the bottom surface of the first throat plate 40, a torsion coil spring 57 for secondarily pressing the pin 512 to the rear side is provided. Accordingly, when the operating lever presser 55 is pivotally operated, it is necessary to perform the operation by applying a force to overcome the convex portion 551*a* against the tension spring 54 and the torsion coil spring 57.

[Position Sensor]

Figure 4:
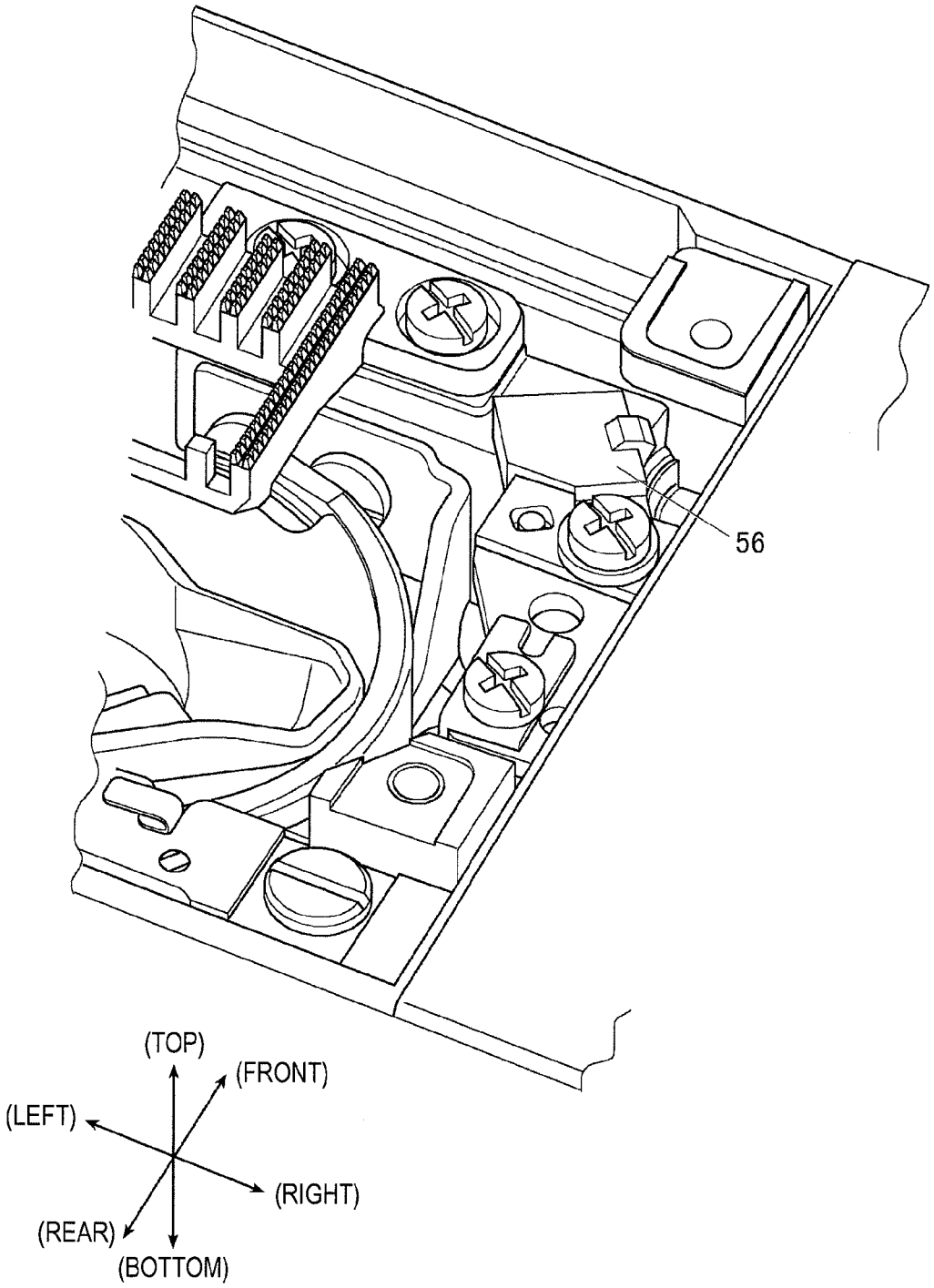
FIG. 4 is a perspective view illustrating a mounting state of a position sensor in a bed portion.
Figure 5:
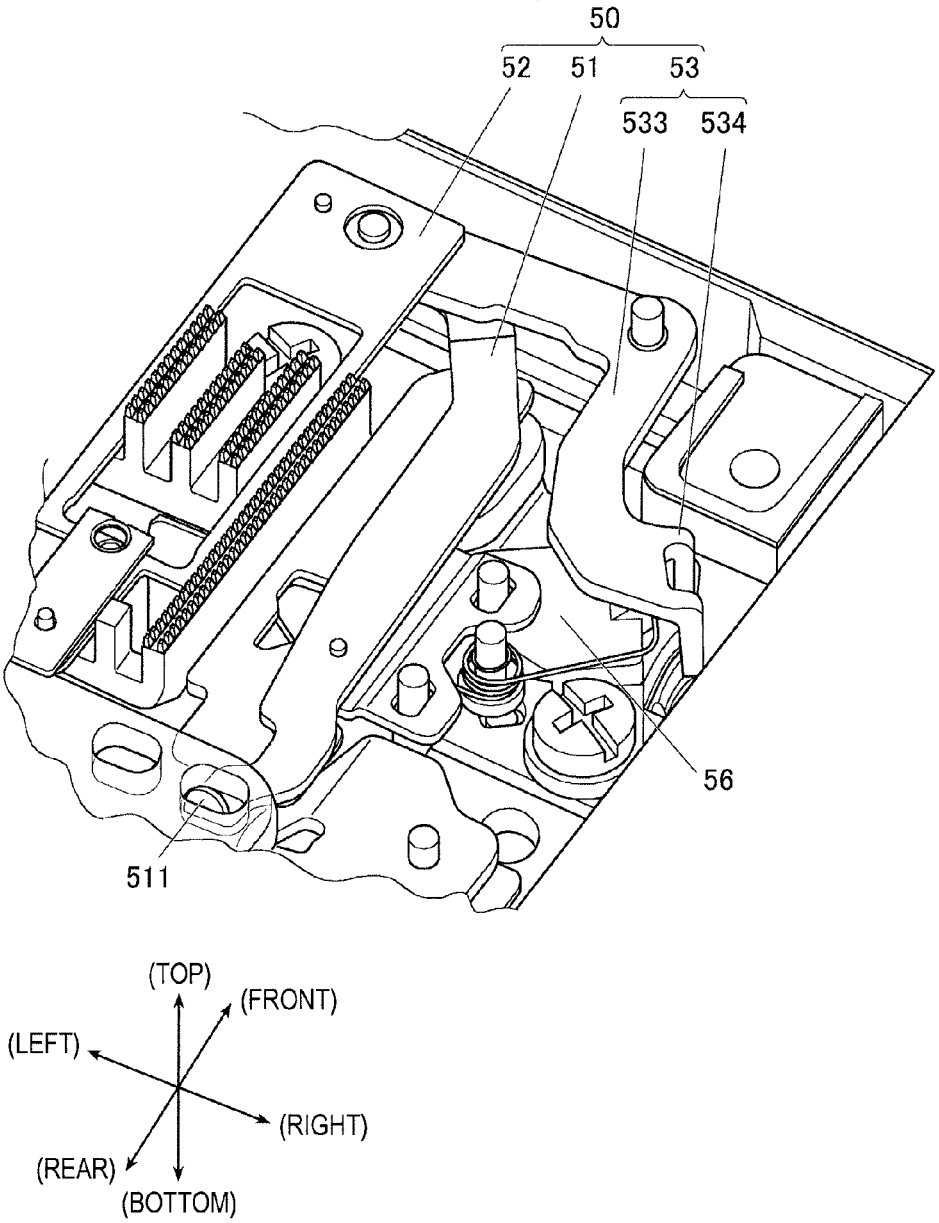
FIG. 5 is a perspective view illustrating a detected state of the position sensor.
Figure 6:
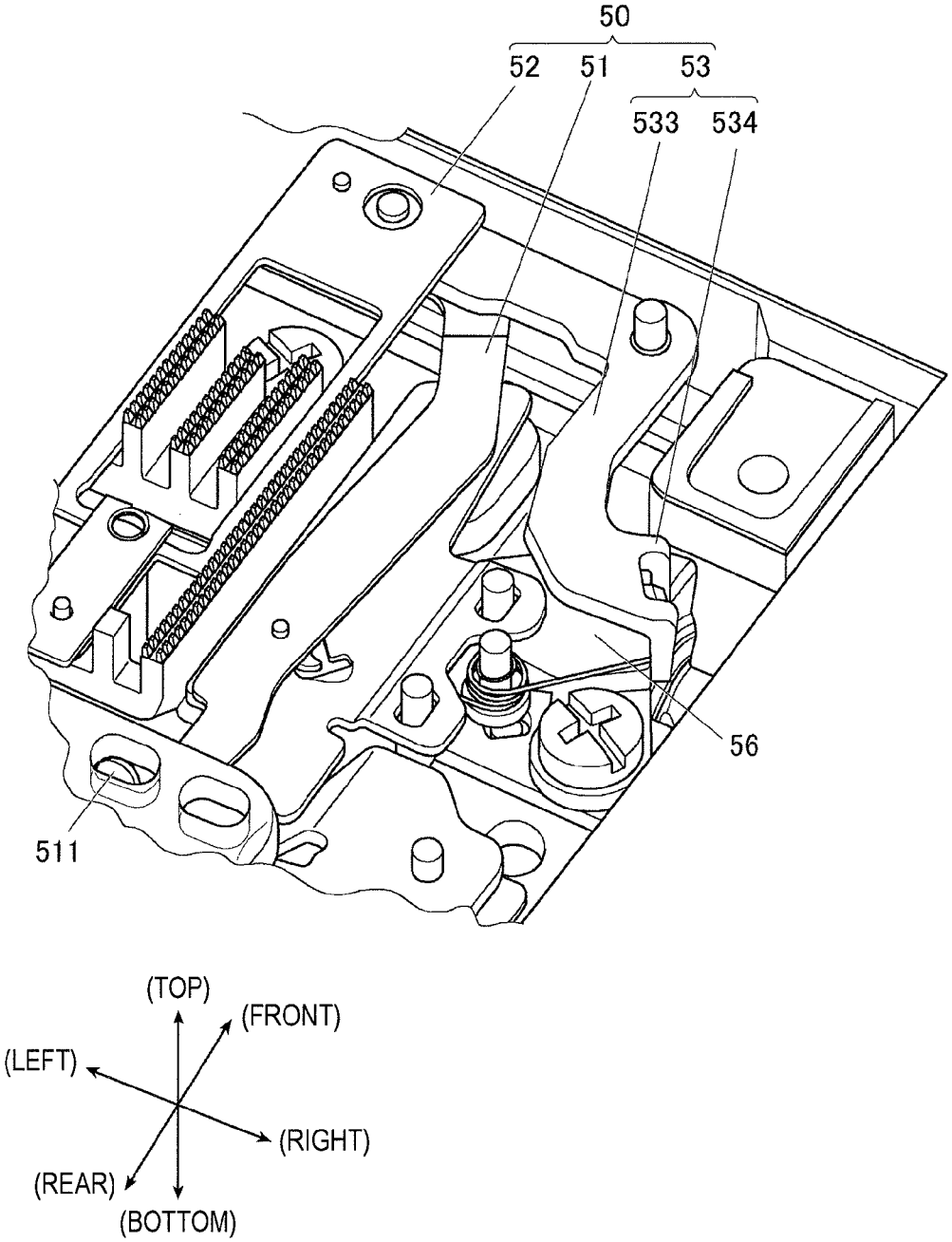
FIG. 6 is a perspective view illustrating a detection state of the position sensor.

FIG. 4 is a perspective view illustrating a mounting state of the position sensor 56 in the bed portion, FIG. 5 is a perspective view illustrating a non-detection state of the position sensor 56, and FIG. 6 is a perspective view illustrating a detection state of the position sensor 56.

The position sensor 56 is fixedly mounted on the frame of the bed portion, below the right front end of the first throat plate 20. This position sensor 56 is provided with a lever-like protrusion (not illustrated) protruding to the right diagonal front side, and it is possible to detect that the second throat plate 40 is at the use position when pressing the protrusion by the detection target portion 534 of the drive arm 53.

Meanwhile, the detection target portion 534 of the second pivot arm 533 of the drive arm 53 of the aforementioned position switching mechanism 50 is formed into a shape that is capable of pressing the protrusion of the position sensor 56. As illustrated in FIG. 5, when the second throat plate 40 is at the retracted position, the detection target portion 534 of the second pivot arm 533 is spaced apart from the position sensor 56 to the right diagonal front side. As illustrated in FIG. 6, when the second throat plate 40 is at the use position, the drive arm 53 is disposed so that the protrusion of the position sensor 56 abuts against the opening of the detection target portion 534 of the second pivot arm 533. Therefore, since the protrusion of the position sensor 56 is in a state of being pressed to the detection target portion 534 when the second throat plate 40 is at the use position, it is possible to detect that the second throat plate 40 is at the use position by the position sensor 56.

For example, the detection signal of the position sensor 56 is input to the control device of the sewing machine, and it is possible to recognize whether the second throat plate 40 is at the use position or the retracted position.

The sewing machine control device checks the detection of the position sensor 56 when performing the stitching using the operation of the needle oscillation or the stitching using a plurality of needles. When the second throat plate 40 is detected to be located at the retracted position, the sewing machine control device allows the stitching using the operation of the needle oscillation or the stitching using a plurality of needles and executes the stitching as it is. When the second throat plate 40 is detected to be located at the use position, the sewing machine control device prohibits the stitching using the operation of the needle oscillation or the stitching using a plurality of needles, and performs an operation control of warning the user of the sewing machine.

[Shuttle Cover]

As described above, the shuttle cover 30 is fitted to the throat plate opening 23 of the first throat plate 20 to be able to cover the entire throat plate opening 23.

As described above, the operating end portion 511 of the operating lever 51 of the position switching mechanism 50 is disposed in the inner region of the throat plate opening 23. When the operating lever 51 is operated to the right side, the second throat plate 40 is located at the retracted position, and when the operating lever 51 is operated to the left side, the second throat plate 40 is located at the use position.

The shuttle cover 30 includes a positioning opening 31 that is formed to correspond to the position of the operating end portion 511 when the second throat plate 40 is located at the retracted position, and a positioning opening 32 that is formed to correspond to the position of the operating end portion 511 when the second throat plate 40 is located at the use position.

When the shuttle cover 30 is mounted to the first throat plate 20 after operating the operating lever 51 such that the second throat plate 40 is located at the retracted position, as illustrated in FIG. 1, the operating end portion 511 is fitted to the positioning opening 31, and its position can be maintained.

Similarly, when the shuttle cover 30 is mounted to the first throat plate 40 after operating the operating lever 51 such that the first throat plate 20 is located at the use position, as illustrated in FIG. 2, the operating end portion 511 is fitted to the positioning opening 32, and its position can be maintained.

Figure 7:
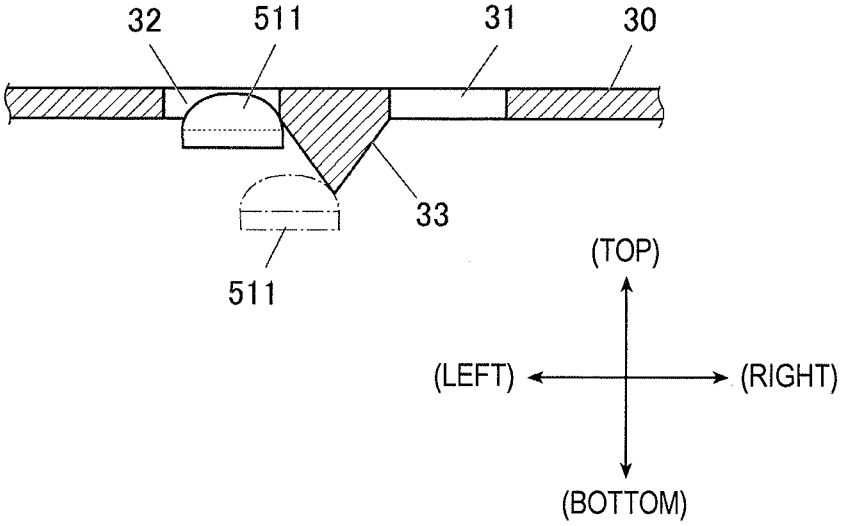
FIG. 7 is a cross-sectional view of a shuttle cover of the cross-section along a left-right direction that passes through two positioning openings.

FIG. 7 is a cross-sectional view of the shuttle cover 30 by the cross-section taken along the left-right direction and the vertical direction passing through the two positioning openings 31 and 32.

As illustrated in FIG. 7, on the bottom surface of the shuttle cover 30, between the two positioning openings 31 and 32, a guide protrusion 33 is formed to guide the operating end portion 511 of the operating lever 51 to one of the two positioning openings 31 and 32.

The guide protrusion 33 protrudes downward, and on its left and right side, an inclined surface facing the positioning opening 32 and an inclined surface facing the positioning opening 31 are included. Since the operating end portion 511 of the operating lever 51 has a semicircular shape protruding upward as described above, even if the operating end portion 511 remains between the retracted position and the use position of the second throat plate 40 (two-dot chain line in FIG. 7), the operating end portion 511 abuts against any one of the two inclined surfaces of the guide protrusion 33, and the shuttle cover 30 is pushed downward so as to be mounted to the throat plate opening 23, it is possible to move the operating end portion 511 to one of the positioning openings 31 and 32.

[Technical Effect of Embodiments of the Invention]

In this way, in the throat plate switching mechanism 10 of the sewing machine, the first throat plate 20 is equipped with the second throat plate 40 such that the second throat plate 40 can be switched into the use position at which the second needle hole 41 overlaps the first needle hole 21 and the retracted position at which the second throat plate 40 does not cover the first needle hole 21. Thus, it is possible to select the appropriate needle holes 21 and 41, in accordance with the presence or absence of the needle oscillation caused by the sewing machine, the number of the sewing needles or the like, and it is possible to reduce the occurrence of dents and catching to the workpiece.

Moreover, since the position of the second throat plate 40 can be switched, the replacement of the throat plate itself is not required, the complexity of the replacement work is solved, and it is possible to perform an efficient stitching work by reducing the working time. Moreover, since the replacement of the throat plate is not required, it is possible to prevent the loss of the unused throat plate.

Since the first throat plate 20 of the throat plate switching mechanism 10 is equipped with the operating lever 51 which manually moves the second throat plate 40, the position switching of the second throat plate 40 can be performed by the pivoting operation of the operating lever 51, and it is possible to improve the workability.

In the throat plate switching mechanism 10, the operating lever 51 is mounted on the bottom surface side of the first throat plate 20, the operating end portion 511 of the operating lever 51 is disposed so as to be inside of the throat plate opening 23 in a plan view, and the operating end portion 511 of the operating lever 51 has a semicircular convex shape protruding upward. The positioning openings 31 and 32 are formed in the shuttle cover 30, and the operating end portion 511 when the second throat plate 40 is at the retracted position, and the operating end portion 511 when the second throat plate 40 is at the use position are fitted to the positioning openings 31 and 32, respectively.

Therefore, when the second throat plate 40 is switched to the retracted position or the use position, since the operating end portion 511 of the operating lever 51 is held by being fitted to the opening 31 or 32, it is possible to effectively maintain the second throat plate 40 at the retracted position or the use position. In particular, when the second throat plate 40 moves during stitching, because it can also cause a degradation of stitching quality or a needle breakage, it is possible to effectively suppress the problems.

In addition, the operating end portion 511 of the operating lever 51 has a semicircular convex shape in which the width becomes narrower toward the top, and on the bottom surface of the shuttle cover 30, between the two openings 31 and 32, the guide protrusion 33 for guiding the operating end portion 511 of the operating lever 51 to any one of the two openings 31 and 32 is formed. Thus, even if the operating end portion 511 of the operating lever 51 remains between the two openings 31 and 32, by closing the shuttle cover 30, the guide protrusion 33 abuts against the operating end portion 511 and can guide the operating end portion to one of the opening 31 or the opening 32, and it is possible to avoid the second throat plate 40 from covering the needle hole 21 of the first throat plate 20. Thus, it is possible to effectively reduce the degradation of stitching quality or an occurrence of needle breakage.

Since the throat plate switching mechanism 10 can detect whether the second throat plate 40 is at the use position by the position sensor 56, for example, by inputting the detection output to the control device of the sewing machine or the like, it is possible to achieve optimization of stitching, such as determining whether the stitching performed by the sewing machine and the needle hole 21 or 41 for use is appropriate.

[Others]

A recess that does not penetrate may be formed, in place of the positioning openings 31 and 32 formed through the shuttle cover 30.

Although the description was given of a case where the operating end portion 511 of the operating lever 51 is moved in the left-right direction, and the positioning openings 31 and 32 of the shuttle cover 30 are also aligned side by side in the left-right direction in response thereto, a configuration in which the operating end portion 511 of the operating lever 51 moves back and forth to perform the position switching of the second throat plate 40 may be adopted, and the positioning openings 31 and 32 of the shuttle cover 30 may also be aligned side by side in the front-rear direction.

What is claimed is:

1. A throat plate switching mechanism comprising:

a first throat plate that is formed with a first needle hole having an elongated hole shape at a stitch point;

a second throat plate that is formed with a second needle hole; and a shuttle cover that is attachable to and detachable from a throat plate opening which is formed in the first throat plate, wherein a width of the second needle hole is narrower than a width of the first needle hole, the second throat plate is equipped in the first throat plate such that the second throat plate is switched into a use position at which the second needle hole overlaps the first needle hole, and a retreated position at which the second throat plate does not cover the first needle hole, the first throat plate is equipped with an operating lever which manually moves the second throat plate, the operating lever is mounted on a bottom surface side of the first throat plate, and an operating end portion of the operating lever is disposed so as to be the inner side of the throat plate opening in a plan view, the operating end portion of the operating lever has a convex shape which protrudes upward, and the shuttle cover is formed with two recesses, wherein the operating end portion is fitted to one recess when the second throat plate is at the use position, and the operating end portion is fitted to the other recess when the second throat plate is at the retracted position, respectively, or the shuttle cover is formed with two openings, wherein the operating end portion is fitted to one opening when the second throat plate is at the use position, and the operating end portion is fitted to the other opening when the second throat plate is at the retracted position, respectively.

2. The throat plate switching mechanism according to claim 1, wherein the operating end portion of the operating lever has a convex shape which width is gradually narrower upward, and a guide protrusion is formed on a bottom surface of the shuttle cover between the two recesses or between the two openings, and is configured to guide the operating end portion of the operating lever to one of the two recesses or one of the two openings.

* * * * *